United States Patent [19]

Lee et al.

[11] Patent Number: 5,072,149

[45] Date of Patent: Dec. 10, 1991

[54] CATHODE FOR ELECTRON GUN AND ITS MANUFACTURING METHOD

[75] Inventors: An-sub Lee; Kyung-cheon Sohn, both of Suwon, Rep. of Korea

[73] Assignee: Samsung Electron Devices Co., Ltd., Kyunggi-do, Rep. of Korea

[21] Appl. No.: 578,611

[22] Filed: Sep. 7, 1990

[30] Foreign Application Priority Data

Sep. 7, 1989 [KR] Rep. of Korea ..... 89-12970

[51] Int. Cl.[5] ..... H01J 19/06

[52] U.S. Cl. ..... 313/346 R; 313/346 DC; 313/311; 252/521

[58] Field of Search ..... 313/346 R, 346 DC, 311; 252/521, 518

[56] References Cited

U.S. PATENT DOCUMENTS 4,797,593 1/1989 Saito et al. ..... 313/346 R 4,864,187 9/1989 Sano et al. ..... 313/346 R

*Primary Examiner*—Donald J. Yukso

*Assistant Examiner*—Diab Hamadi

*Attorney, Agent, or Firm*—Cushman, Darby & Cushman

[57] ABSTRACT

A cathode for an electron gun and its manufacturing method are disclosed. The cathode comprises thermoelectron emission substance layer composed of triple composite oxide of alkaline earth metal formed by thermally decomposing triple carbonate of alkaline earth metal such as barium, strontium and calcium, containing a fourth substance. The fourth substance consists of scandium nitrate or indium nitrate so that the fourth substance can be uniformly dispersed into the thermoelectron emission substance layer, and thus the thermoelectron emission characteristics and durability of the cathode can be remarkably enhanced.

4 Claims, 1 Drawing Sheet

CATHODE FOR ELECTRON GUN AND ITS MANUFACTURING METHOD

BACKGROUND OF THE INVENTION

The present invention relates generally to a cathode for an electron gun and its manufacturing method, and more particularly to a cathode for an electron gun of which thermoelectron emission characteristics is enhanced and of which durability is prolonged and to a method thereof especially adapted for manufacturing it.

Conventional cathode for an electron gun of a cathode ray tube, as shown in FIG. 1, comprises normally a cylindrical-type sleeve 1, a nickel base metal 2 containing a small amount of silicon, magnesium and the like and capping the top portion of the sleeve 1, a thermoelectron emission substance layer 3 composed of alkaline earth metal carbonate such as barium (expressed as Ba), strontium (Sr) and calcium (Ca) and deposited on the base metal 2, and a heating element 4 provided in the sleeve 1.

In the above-described cathode for an electron gun, the thermoelectron emission substance layer will be typically manufacturing by the following process.

First, a compound is prepared by mixing the powder of carbonate of alkaline earth metal such as barium, strontium and calcium with binder and organic solvent such as isoamyl acetate, n-butanol, butyl acetate and the like, and then a suspension is prepred by dispersing the compound through a ball mill. Here, emission paste(it is referred to as EP hereinafter) as thermoelectron emission substance is obtained by mixing the suspension for a period of 24 hours. The EP is deposited on the above-described base metal through spraying process so as to form a thermoelectron emission substance layer.

The thermoelectron emission substance layer formed by the above process is changed into composite oxide through an aging step of the cathode ray tube manufacturing process.

In case where the thermoelectron emission substance is composed of carbonate of alkaline earth metal such as barium, strontium and calcium, that will be changed into the triple composite oxide of barium, strontium and calcium by the following chemical formula.

$$(Ba, Sr, Ca)CO_3 \xrightarrow{heating} (Ba, Sr, Ca)O + CO_2 \uparrow$$

The composite oxide formed by the above process is heated to about 900°~1100° C. once again, and through the heating process, the composite oxide is reacted by the following chemical formula by means of reducing agents such as silicon and magnesium contained in the base metal, and thus some part of composite oxide will have the characteristics of semiconductor.

$$2BaO + Si \rightarrow 2Ba + SiO_2$$

$$BaO + Mg \rightarrow Ba + MgO$$

In the above chemical formula, it has been found that a part of BaO contained in the compound of alkaline earth metal is deoxidized to generate free barium under high temperature atmosphere, thereby effecting the thermoelectron emission.

However, the cathode manufactured by the above-described process has problems as follows.

1) An intermediate resistance layer composed of $Ba_2SiO_4$ or the like is formed in an interface between the base metal and the thermoelectron emission substance layer due to the result of the deoxidization reaction during an activation process, and therefore the intermediate resistance layer will interrupt the flow of electric current.

2) Since the intermediate resistance layer is present and continues to grow, the composite oxide of alkaline earth metal and the reducible element are restrained from reacting together, thus suppressing the generation of free barium.

3) The thermoelectron emission substance layer and the intermediate resistance layer are oxide layers having a low electric conductivity, so that, if they are forced to generate a large quantity of thermoelectrons, the joule heat is excessively generated by the electric resistance, having thermoelectron emission substance rapidly consumed. That will result in the shortening of the durability of the electron gun.

For solving the above-mentioned problems, there have been disclosed cathode manufacturing methods in Japanese laid open patent publication No. 61-269828 and No. 61-271732.

In these methods, scandium oxide (expressed as $Sc_2O_3$) treated with heating at a temperature of from 800° to 1100° C. under atmospheric pressure for 30 minutes to 2 hours is mixed with EP of thermoelectron emission substance in the ratio of 0.1~20% by the weight of scandium oxide to EP. That will be capable of manufacturing a cathode having electric current density 2 A/cm$^2$ and 30,000 hours in life time.

However, the above-described cathode manufacturing method using the additive $Sc_2O_3$ has the following problems due to adding $Sc_2O_3$ as fourth substance in powder state to EP.

1) Since the scandium oxide is added to EP not only in powder state but also in extremely small amount in comparison with that of EP, it is very difficult to have the scandium oxide uniformly distributed into the thermoelectron emission substance layer provided on the base metal even though using EP sufficiently dispersed.

2) For that reason, scandium oxide in powder state may be locally concentrated on the thermoelectron emission substance layer provided on the base metal, and thus that will form a portion of the scandium oxide into composite oxide together with barium, strontium and calcium. That will cause the nonuniform distribution of electric conductivity to occur, thereby to bring about the unbalance in the thermoelectron emission characteristics.

3) Accordingly, for enhancing the dispersion state of the scandium oxide, a large amount of the scandium oxide more than that actually used should be consumed, thereby increasing in production cost.

SUMMARY OF THE INVENTION

Therefore, it is an object of the present invention to provide a cathode for an electron gun of which thermoelectron emission characteristics substantially enhanced by improving the dispersion state of the reducing agent contained in the thermoelectron emission substance with a view to solving the above-mentioned problems.

Another object of the present invention is to provide a cathode manufacturing method by which a reducing agent can be uniformly dispersed into the thermoelectron emission substance so as to enhance the thermoelectron emission characteristics of a cathode for an electron gun.

To accomplish the above objects, there is provided, in accordance with an aspect of the present invention, a cathode for an electron gun, which cathode comprises thermoelectron emission substance layer composed of triple composite oxide of alkaline earth metal formed by thermally decomposing triple carbonate of alkaline earth metal such as barium, strontium and calcium, the layer containing a fourth substance, characterized in that the fourth substance consists of rare earth, scandium nitrate, rare earth nitrate or indium nitrate.

In accordance with another aspect of the present invention, there is provided a cathode manufacturing method wherein the cathode comprises thermoelectron emission substance layer composed of triple carbonate of alkaline earth metal such as barium, strontium and calcium, containing fourth substance, characterized in that the method comprises a dipping step for dipping the tripple carbonate of alkaline earth metal into a solution including the fourth substance dissolved therein.

In the preferred embodiment, the method is characterized in that the fourth substance is selected from at least any one of scandium nitrate and indium nitrate.

The invention, together with further objects and advantages thereof, may best be understood by referring to the following description.

DETAILED DESCRIPTION OF THE PREFERRED EMBODIMENT

Figure 1:
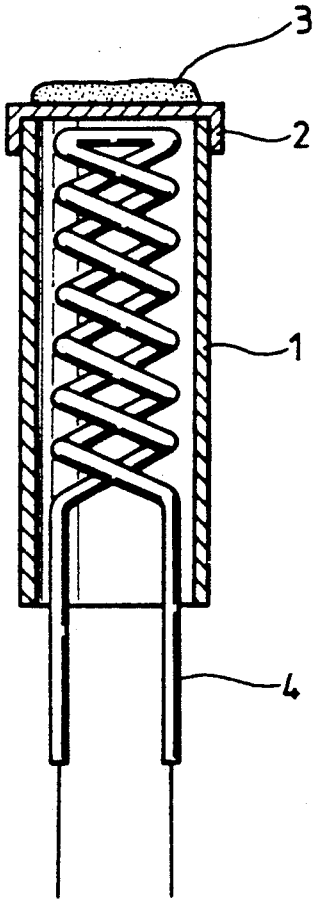
FIG. 1 is a schematic partly cross-sectioned elevational view of a typical cathode for an electron gun.

The invention will be described by specific examples.

EXAMPLE 1

Triple carbonate powder of alkaline earth metal such as barium, strontium and calcium was introduced into a normal type container and made dense by means of a vibrating apparatus or the like.

On the other hand, scandium nitrate was dissolved with solvent such as water, alcohol or the like in order to prepare a solution, and then the solution was dropped into the container at a predetermined rate, and thereafter was left for a few hours under a reduced pressure.

At that time, according to the sort of used solvent, the solution was left at over the boiling point of the solvent until the solution would come up to a desired amount.

After lapse of a predetermined time, nitrocellulose and butyl acetate were mixed into the aforesaid carbonate to prepare EP and then EP was deposited on the base metal of a cathode to form a thermoelectron emission substance layer thereon. After the layer was dried out, the thermoelectron emission substance layer was obtained.

In the above process, scandium had about 1% in concentration, and it had been noticed that the lower content of scandium had, the more diversity of distribution uniformity appeared.

The cathode manufactured by the above method was then aged at the high temperature through the pyrolysis process in the state assembled to the electron gun. Since scandium was covered in nitrate state on the triple carbonate of alkaline earth metal, scandium nitrate was changed due to the high temperature into scandium oxide, and at that time, nitrous oxide produced in the above process was exhausted to the outside of the system by a typical exhausting apparatus.

EXAMPLE 2

The cathode was manufactured through a procedure similar to that used for Example 1 except for using indium nitrate instead of scandium nitrate as the fourth substance.

In the cathode manufactured by Example 2, indium nitrate was decomposed through the pyrolysis process to be changed into indium oxide as Example 1, and also nitrous oxide was exhausted by a typical exhausting apparatus to the outside of the system together with carbon dioxide decomposed from carbonate.

According to the present invention as described above, scandium nitrate, rare earth nitrate or indium nitrate used for the fourth substance was dissolved with solvent to prepare a solution which was dropped and uniformly dispersed into the triple carbonate of alkaline earth metal in powder state.

The distribution uniformity of the fourth substance, for example, scandium oxide contained in carbonate of alkaline earth metal manufactured by the method according to the present invention and the distribution uniformity of scandium oxide contained in the cathode manufactured by conventional method were comparatively measured through an electron microscope. From the result of that measurement, it had been found that the distribution of the fourth substance in the cathode manufactured by the method according to the present invention was more uniform than that manufactured by the conventional method.

Furthermore, as the result of applying the cathode manufactured by the method according to the present invention to an electron gun, it had been proved that the thermoelectron emission characteristics and durability of the cathode in accordance with the present invention were remarkably enhanced in comparison with those of conventional cathode.

It will of course be understood that the present invention have been described above purely by way of example, and various modification may be made without departing the spirit of the invention and scope of the appended claims.

What is claimed is:

1. A cathode for an electron gun, which cathode comprises a thermoelectron emission substance layer composed of a triple composite oxide of an alkaline earth metal formed by thermally decomposing said triple carbonate of an alkaline earth metal selected from the group consisting of barium, strontium and calcium, said layer containing a fourth substance, wherein said fourth substance is a material selected from the group consisting of scandium nitrate, rare earth nitrate, and indium nitrate.

2. A cathode according to claim 1, wherein said fourth substance is at least partially covering on the surface of said triple carbonate particles.

3. A cathode manufacturing method, wherein said cathode comprises a thermoelectron emission substance layer composed of a triple carbonate oxide of an alkaline earth metal selected from the group consisting of barium, strontium and calcium, and said method comprises a dipping step for dipping said triple carbonate alkaline earth metal into a solution including a fourth substance.

4. The method according to claim 3, wherein said fourth substance is a material selected from the group consisting of scandium nitrate, rare earth nitrate, and indium nitrate.

* * * * *